US006729702B1

(12) United States Patent
Parker et al.

(10) Patent No.: US 6,729,702 B1
(45) Date of Patent: May 4, 2004

(54) REINFORCED DRAWER PEDESTAL

(75) Inventors: Brian G. Parker, Alto, MI (US); Tanya A. Best, Alto, MI (US)

(73) Assignee: Cascade Engineering, Inc., Grand Rapids, MI (US)

( * ) Notice: Subject to any disclaimer, the term of this patent is extended or adjusted under 35 U.S.C. 154(b) by 101 days.

(21) Appl. No.: 10/124,022

(22) Filed: Apr. 17, 2002

(51) Int. Cl.[7] ..... A47B 47/00
(52) U.S. Cl. ..... 312/263; 312/406
(58) Field of Search ..... 312/257.1, 330.1, 312/265.5, 351, 348.6, 334.27, 334.31, 334.32, 263, 249.11, 400, 406, 406.1

(56) References Cited

U.S. PATENT DOCUMENTS 538,954 A * 5/1895 Eastman et al. ..... 109/54
1,967,257 A * 7/1934 Pickup ..... 126/39 B
2,275,365 A * 3/1942 Hintze ..... 62/453
4,199,205 A * 4/1980 Cooke et al. ..... 312/406
4,786,121 A * 11/1988 Lyons ..... 312/350
4,852,932 A * 8/1989 Komeya et al. ..... 296/37.9
5,356,212 A * 10/1994 Okopny ..... 312/263
5,378,057 A * 1/1995 Bach et al. ..... 312/257.1
5,944,398 A 8/1999 Wu
5,975,659 A 11/1999 Yang et al.
6,056,383 A * 5/2000 Banicevic et al. ..... 312/406
6,394,563 B2 5/2002 Sugamura
2003/0080654 A1 5/2003 Chen et al.

* cited by examiner

*Primary Examiner*—Janet M. Wilkens
(74) *Attorney, Agent, or Firm*—Warner Norcross & Judd LLP

(57) ABSTRACT

A drawer pedestal including a structural support for reinforcing working surfaces of the pedestal. The drawer pedestal includes a shell and a substructure that define a cavity. The shell includes a panel that forms the top surface of the pedestal. A first structure, preferably defining a compartment, projects into the cavity. The support includes first and second side panels connected to one another by a top support panel. In a preferred embodiment, the support is frictionally fit between the first structure and the top panel of the shell to reinforce that top panel. In a more preferred embodiment, the support is constructed from expanded polystyrene foam. The support optionally includes openings that accept guide tabs on the substructure or shell of the drawer pedestal.

17 Claims, 9 Drawing Sheets

REINFORCED DRAWER PEDESTAL

BACKGROUND OF INVENTION

The present invention relates to furniture and, more specifically, to drawer pedestal units for office furniture.

Drawer pedestals are capable of increasing the storage space in office and home environments. Conventional drawer pedestals are constructed to either stand alone or be positioned under a desk, table or similar structure.

A typical drawer pedestal includes several drawers positioned one over the other in an open-faced box-like cabinet. The pedestal includes drawer slides fastened to vertical side walls. The drawers include rollers that interfit within the drawer slides to allow the drawers to be slid in and out from the pedestal. Most of the components of the typical drawer pedestal are constructed of metal and fastened together with screws or bolts.

Although conventional drawer pedestals are capable of increasing storage space, they suffer several shortcomings. First, because the drawer components of the drawer pedestals usually are constructed from metal, the resulting unit is quite heavy. This makes shipping expensive, and makes movement of the pedestals around the office or home difficult. Second, with various moving metal parts and fasteners to connect components, it is difficult and time consuming to assemble the drawer pedestals. Third, because the components are made from rigid metal they do not stack well, which makes storage of unassembled components space-consuming.

One solution to the problems associated with conventional metal drawer pedestals is to replace the metal panels of drawer pedestals and drawers with plastic panels. However, in many cases, plastic-paneled drawer pedestals tend to be less rigid than their metal counterparts. Accordingly, the plastic pedestals fail to provide adequate support for heavy or multiple objects placed on top of the unit. For example, users frequently stack objects on the top panel of drawer pedestals or use the top as a work surface. With plastic pedestals, the top panel has a tendency to deflect or bow under relatively small loads. Over time, multiple deflections from loads may cause the plastic top panel to separate from the side walls to which it is connected, and in some cases, cave into the pedestal.

It is therefore desirable in the art to have a drawer pedestal that is lightweight, and therefore easy to handle and ship, but that is sufficiently sturdy to support objects placed on it.

SUMMARY OF THE INVENTION

The aforementioned problems are overcome by the present invention wherein a drawer pedestal is provided that includes an internal compartment structure, a top panel, and a structural support member positioned between the top panel and the compartment structure, which transfers loads from the top panel to the compartment structure.

In a first aspect of the invention, the drawer pedestal includes a shell and a substructure that cooperate to define a storage space within the drawer pedestal. The substructure includes a compartment structure that projects into the storage space. The shell includes a top panel, which forms the top surface of the drawer pedestal, above the compartment structure. A structural support is frictionally fit between the compartment structure and the top panel.

In a variation of the first aspect, the shell includes upright side walls, one of which defines a compartment structure opening. The compartment structure of the substructure projects through the storage space of the drawer pedestal and interfits within the compartment structure opening.

The present invention provides a drawer pedestal that is lightweight, yet rigid and sturdy enough to place objects on its top surface without it collapsing after repeated loading. The strength of the top panel is due to the support, which transfers loads from the top panel to the compartment structure and the substructure. With the compartment structure intermitting in the side wall compartment opening, additional loads also may be transferred from the top panel to the shell of the drawer pedestal. Accordingly, users may use the top surface of the drawer pedestal as additional storage or work space with little concern of the surface deforming or collapsing.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
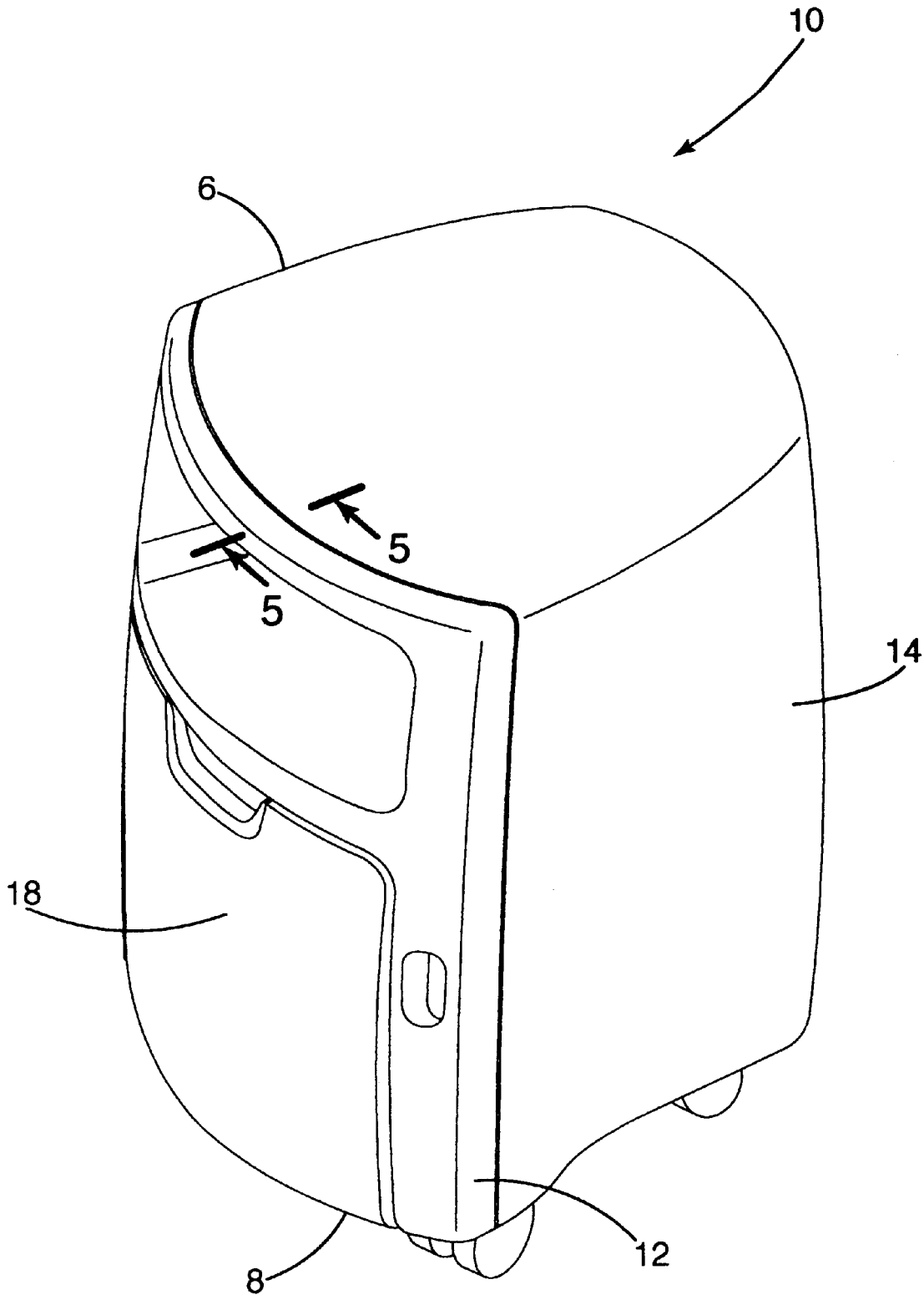
FIG. 1 is a perspective view of a drawer pedestal according to a preferred embodiment of the present invention.
Figure 2:
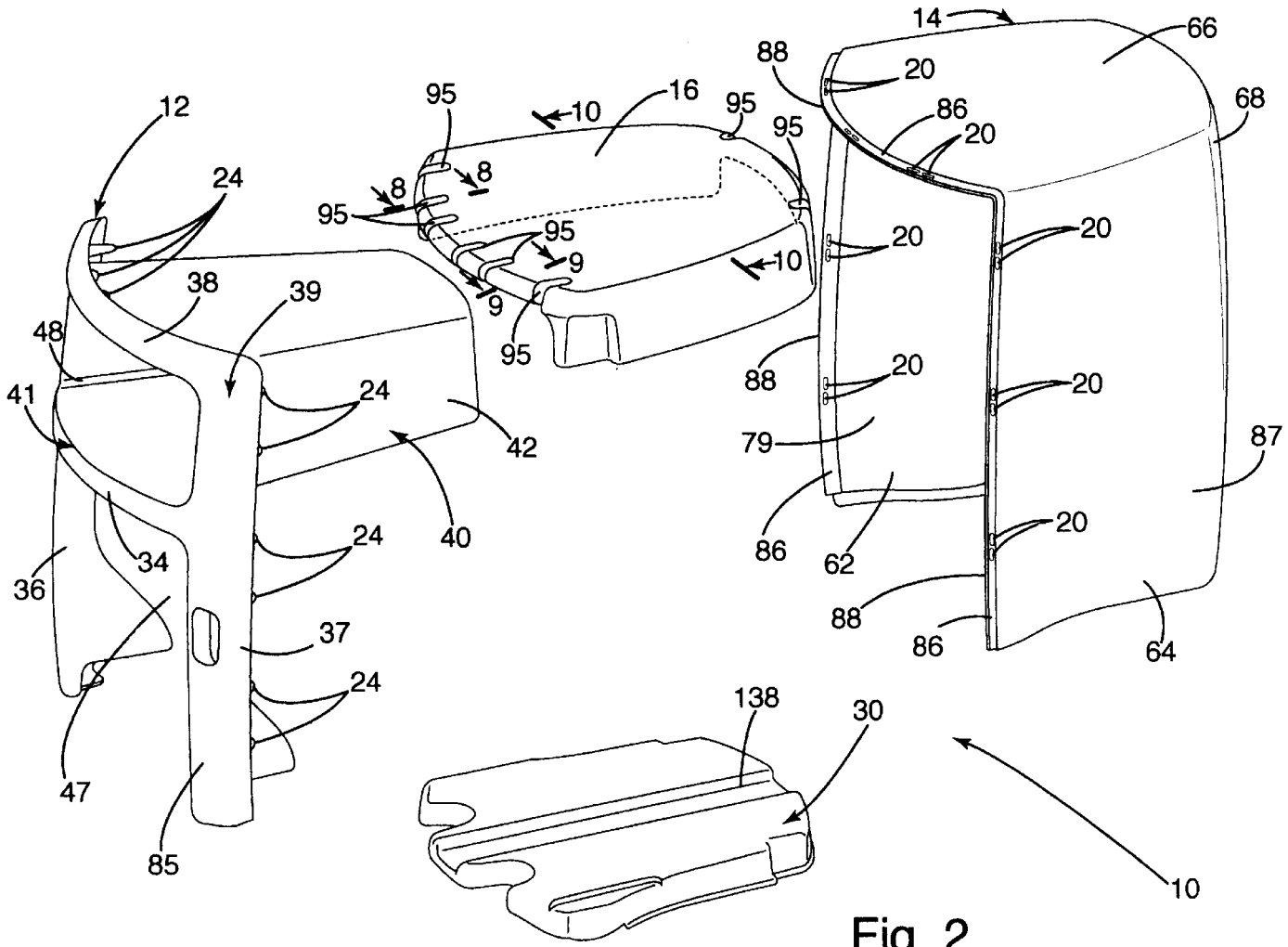
FIG. 2 is an exploded view of the drawer pedestal.
Figure 3:
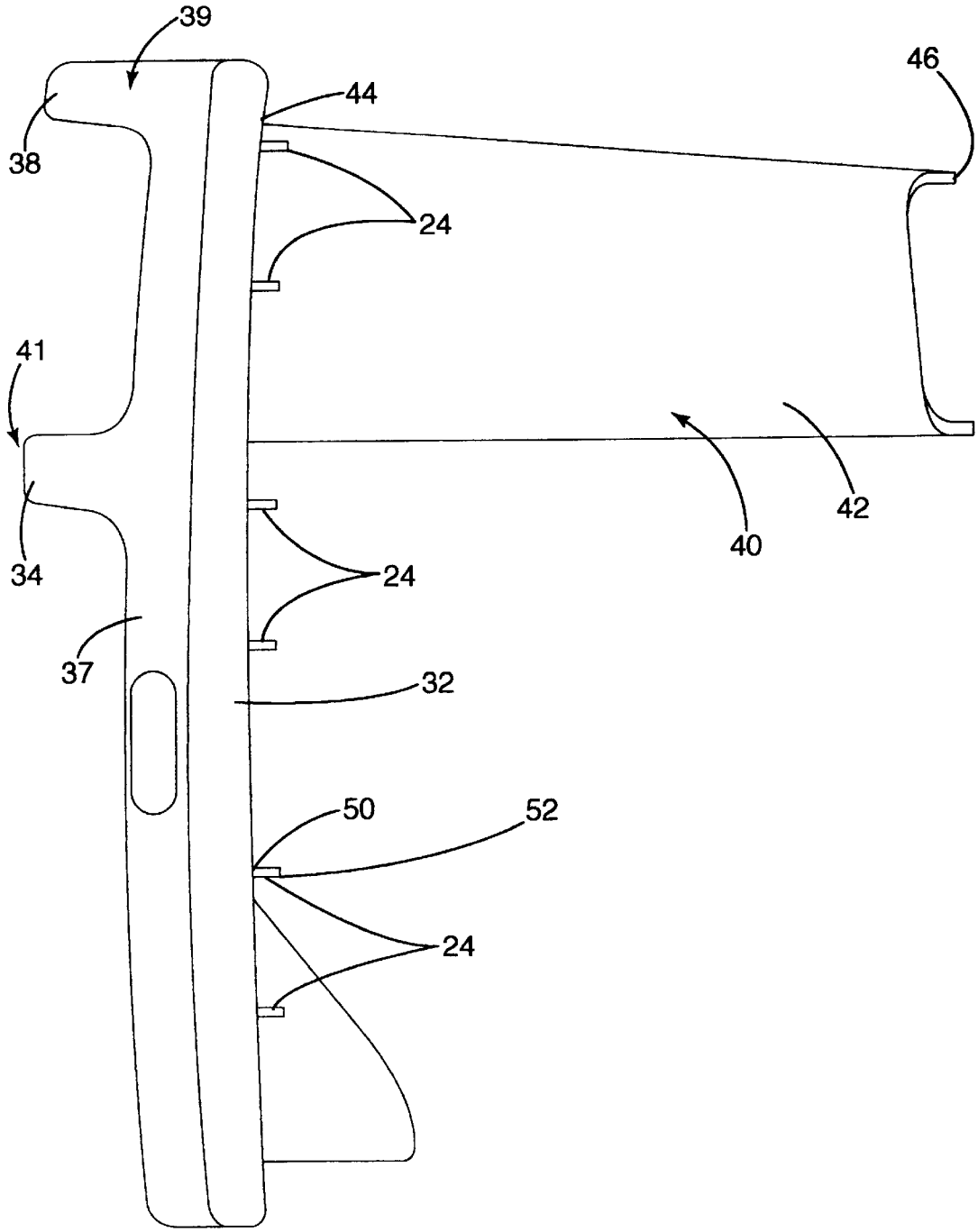
FIG. 3 is a left side elevational view of a substructure of drawer pedestal.

A drawer pedestal 10 in accordance with a preferred embodiment of the present invention is shown generally in FIGS. 1 and 2. The pedestal 10 generally includes a top 6, a bottom 8, a substructure 12, a shell 14, and drawer 18. The shell 14 includes slots 20 and the substructure 12 includes locking tabs 22. The locking tabs 22 and slots 20, however, may be associated with either the shell 14 or substructure 12, in alternating or random combination. Locking tabs 22 interlock with slots 20 to hold the substructure 12 and shell 14 together. A support 16 is interfit between the substructure 12 and the shell 14 to add rigidity and strength to the assembled drawer pedestal. Additionally, drawer 18 may be interfit within the assembled drawer pedestal. Although the present invention is described here in relation to a generally rectangular drawer pedestal, it is well suited for use with essentially any type of furniture unit of any shape. Moreover, the present invention may also be used in a variety of other products, for example, televisions, telephones, appliances, automotive trim and the like.

I. Construction

The components of the pedestal 10 are described in greater detail below with reference to FIGS. 2–16. In the preferred embodiment, the components are constructed from injection molded plastic, however other types of plastic, metal or other materials may be used as desired. Additionally, each component preferably is constructed as an integral piece, however, each component may be constructed from one or more separate parts as desired.

A. Substructure

Preferably, the substructure 12 includes a frame 39 and a compartment 40. The frame 39 has a left side 36 and a right side 37 connected by an upper member 38 and a center member 34. The upper member 38, center member 34, left side 36 and right side 37 form the front face 41 of the frame 39. Optionally, additional members may attach the left side 36 and right side 37 of the frame 39. Flanges 32 extend rearward from front face 41. Preferably, a portion of the frame 39 forms part of the external surface of the pedestal 10.

The compartment structure 40 preferably includes compartment walls 42 bounded by a front compartment end 44 and a back compartment end 46. The compartment walls 42 preferably define an opening 48 in the substructure 12, and thus the pedestal 10 when assembled. Optionally, the compartment 40 may resemble a tube. The front compartment end 44 of each compartment wall 42 is connected to a substructure internal surface 26 of the substructure 12. The back compartment end 44 of each compartment wall 42 is connected to the shell 14 as will be explained in greater detail below. When the pedestal 10 is assembled, the compartment 40 forms a shelf, preferably contained, inside the pedestal 10. Optionally, the compartment structure may be substituted with any structure that projects into the cavity defined by the substructure and shell (described below).

Figure 5:
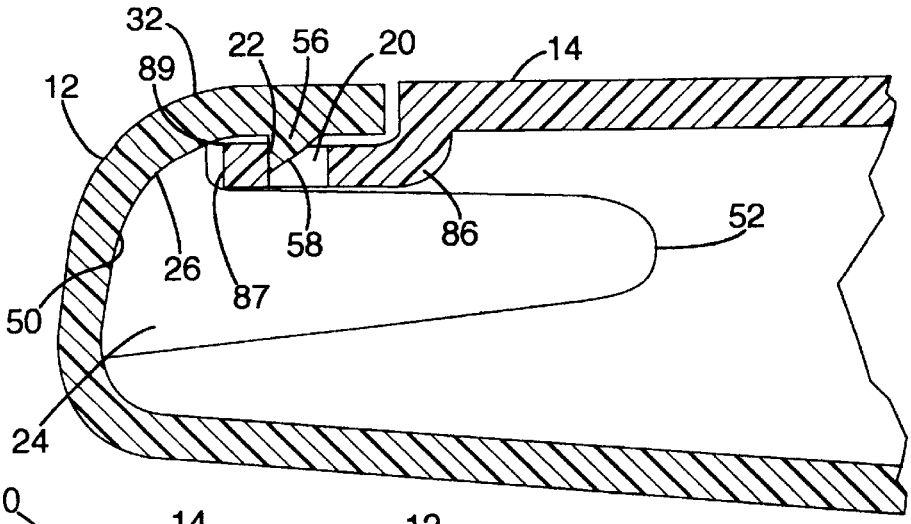
FIG. 5 is a cross-sectional view of the substructure interlocked with a shell of the drawer pedestal taken along line 5—5 of FIG. 1.

The substructure internal surface 26 includes guide tabs 24 and locking tabs 22. The guide tabs 24 are molded as part of the substructure 12, but may also be separate components secured to the substructure internal surface 26. Each guide tab 24 is substantially flat and includes curved corners having a first guide end 50 and a second guide end 52. As will be appreciated, the guide tabs 24 may be other shapes. The first guide end 50 of each guide tab 24 preferably is secured to the substructure internal surface 26. Multiple guide tabs 24 are secured along the left side 36, right side 37 and upper member 38 of substructure 12, along the substructure internal surface 26. The second guide tab end 52 of each guide tab 24 extends beyond the flanges 32 of the substructure 12. Optionally, the guide tabs 24 may extend a distance less than or greater than the depth of flange 32 from substructure internal surface 26, depending on the application. Moreover, the guide tabs 24 may be connected to the substructure internal surface 26 of the center member 34 with a small gap between each guide tab 24 and the adjacent flange 32. The number, shape and positioning of the guide tabs 24 along the substructure 12 may be varied as desired. The guide tabs 24 primarily function to align the flange 32 of substructure 12 with rim 86 of the shell. As shown in FIG. 5, however, they may also or alternatively function to press the rim 86 toward the flange 32, thereby keeping the locking tabs 22 firmly interlocked or engaged with the slots 20.

Figure 4:
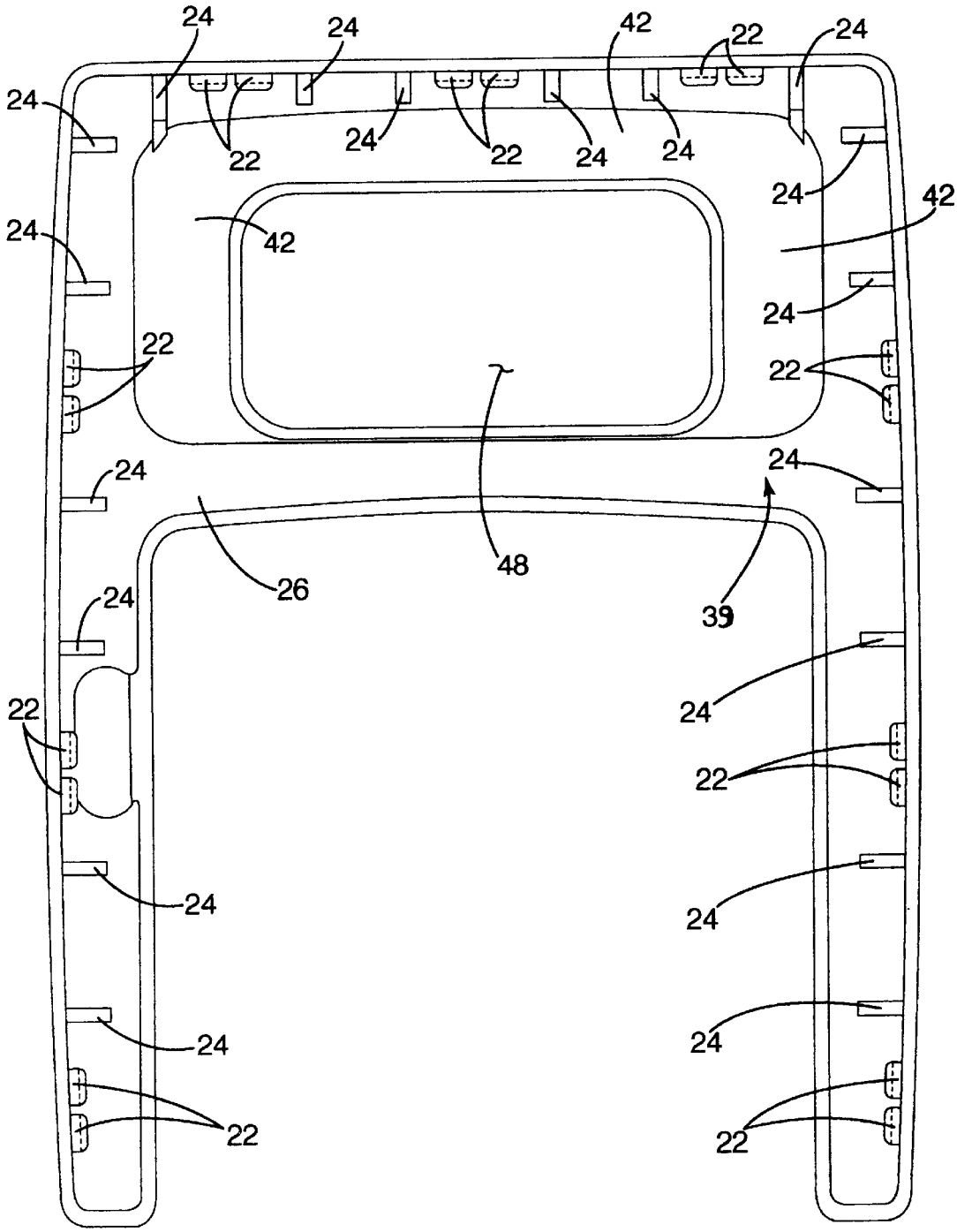
FIG. 4 is a rear elevational view of the substructure.

As shown in FIGS. 4 and 5, the substructure 12 includes locking tabs 22, preferably attached to the substructure internal surface 26 on or near flange 32. Each locking tab includes an angled front face 58 which facilitates moving the locking tab 22 over the corner 89 of rim 86 as the substrate 12 and shell 14 are mated. Optionally, the front face 58 may be curved to perform this function. The base 56 of locking tab 22 is secured to the substructure internal surface 26. The locking tab 22 may be resilient to facilitate entry into slot 20 on shell 14. In a preferred embodiment, the locking tabs 22 are attached to the substructure 12 in adjacent groups, and more preferably in pairs. Optionally, the tabs and slots are grouped in discrete pairs, that is, the distance between the two tabs or slots in a pair is less than the distance between adjacent pairs of tabs or slots. Optionally, groups of tabs and slots of other numbers may be used as desired. The locking tabs 22 are either molded as part of the substructure 12 or molded in pairs in the configuration explained above as separate parts and attached to the substructure 12 by any conventional means.

B. The Shell

Figure 6:
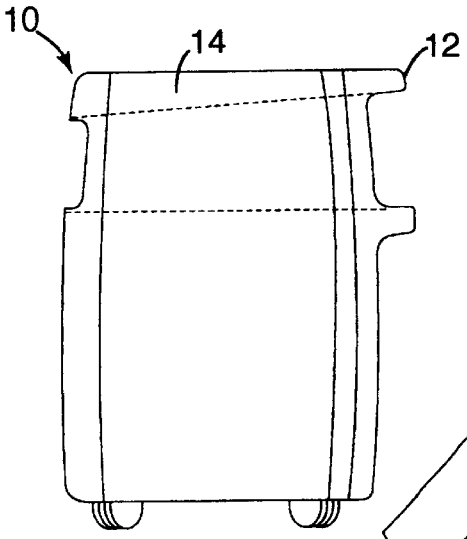
FIG. 6 is a right side elevational view of the drawer pedestal, the left side elevational view being a mirror image thereof.
Figure 7:
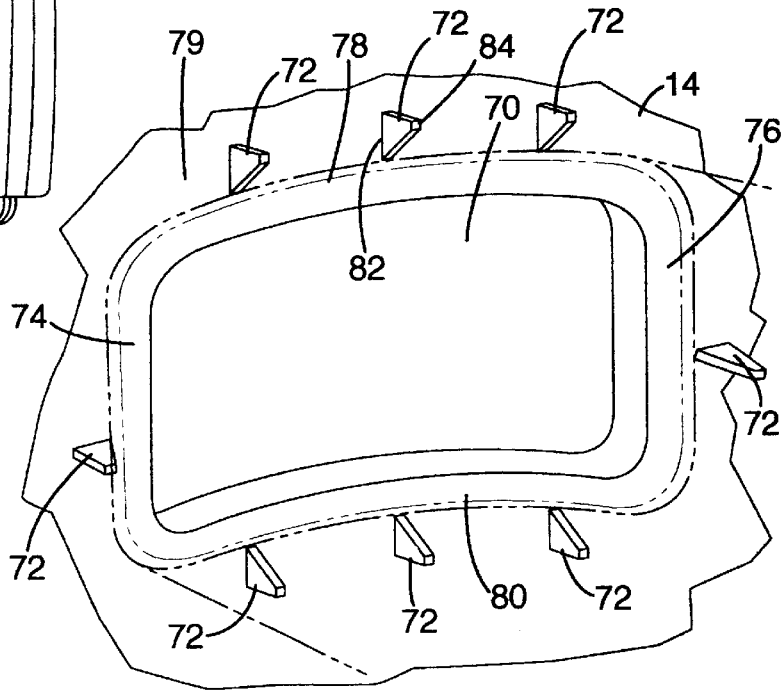
FIG. 7 is a fragmentary perspective view of a compartment opening defined by the shell.

Referring to FIGS. 2, 6 and 7, the shell 14 preferably includes a left shell wall 62, a right shell wall 64, a top shell wall 66, and a back shell wall 68. The shell 14 preferably is rigid enough to be self-supporting, that is, to stand firmly by itself. A compartment opening 70, compartment guide tabs 72 and slots 20 preferably are included in the shell 14. If a base panel 30 is used, it is attached to the bottom of each of the left shell wall 62, right shell wall 64, and back shell wall 68. The base panel 30 may be attached to the pedestal 10 with the interlocking structures defined herein, or with any conventional fastener, for example screws, bolts or glue.

The shell 14 optionally includes compartment guide tabs 72, which have a base end 82 and a tip 84. The compartment guide tabs 72 preferably function to guide compartment 40 into compartment opening 70. The compartment guide tabs 72 are preferably shaped like a right triangle, but other shapes may be used as desired. The compartment guide tabs 72 are attached to the shell 14 along the perimeter of shelf opening 70. Any number of compartment guide tabs 72 may be attached to shell 14 in the following manner. Each compartment guide tab 72 is attached to the shell internal surface 79 so that the tip 84 of each compartment guide tab 72 is the point on the compartment guide tab 72 farthest from the compartment opening 70. Preferably, there are several compartment guide tabs 72 along each of the left opening edge 74, right opening edge 76, top opening edge 78 and bottom opening edge 80 of the compartment opening 70.

With reference to FIG. 2, each of the left shell wall 62, right shell wall 64 and top shell wall 66 of the shell 14 includes a rim 86 having a peripheral edge 88. The rim 86 may be associated with each of the walls collectively or independently. Preferably, the rim 86 is less thick than the left shell wall 62, right shell wall 64 and top shell wall 66. The rim 86 is substantially continuous with the shell internal surface 79 of the adjoining wall. The top shell wall 66 may also referred to as a top panel. Because the wall 66 may also form a work surface it also may be referred to as a work surface panel.

The rim defines slots 20 at or adjacent to the edge 88. These slots preferably are dimensioned to receive the locking tabs 22 of the substructure and thereby interlock the shell 14 and substructure 12.

In a preferred embodiment, the number of slots 20 is equal to the number of locking tabs 22. Additionally, the thickness of the rim 86 is such that when the locking tabs 22 are connected to the slots 20, the substructure external surface 85 is continuous or in substantially the same plane as the shell external surface 87.

C. Support

Figure 8:
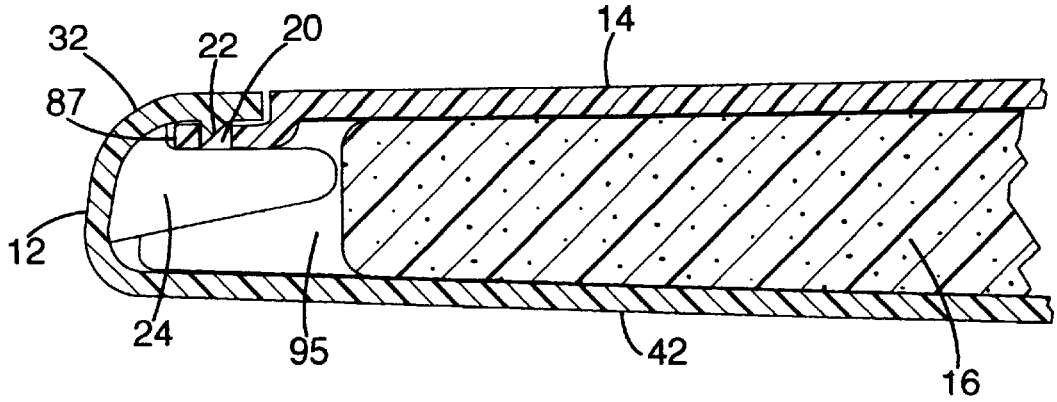
FIG. 8 is an unexploded, cross-sectional view of a support of the drawer pedestal and the shell taken along line 8—8 of FIG. 2.
Figure 9:
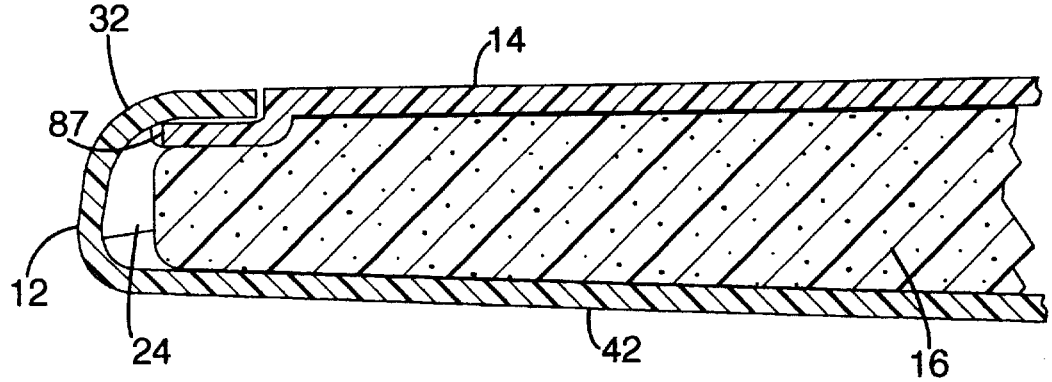
FIG. 9 is an unexploded, cross-sectional view of the support and the shell taken along line 9—9 of FIG. 2.
Figure 10:
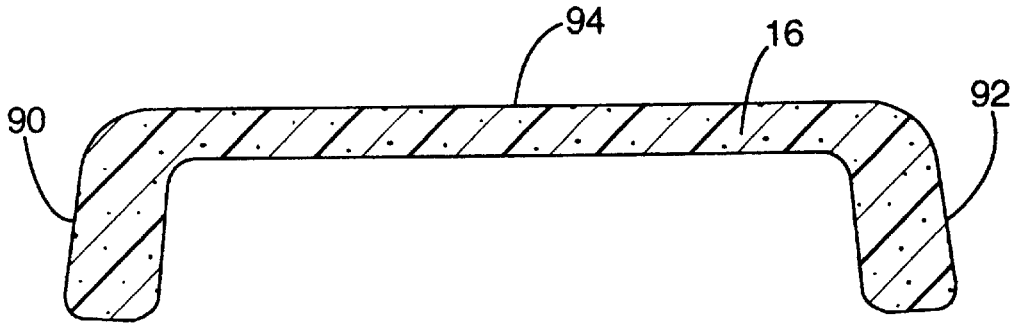
FIG. 10 is a cross-sectional view of the support taken along line 10—10 of FIG. 2.
Figure 11:
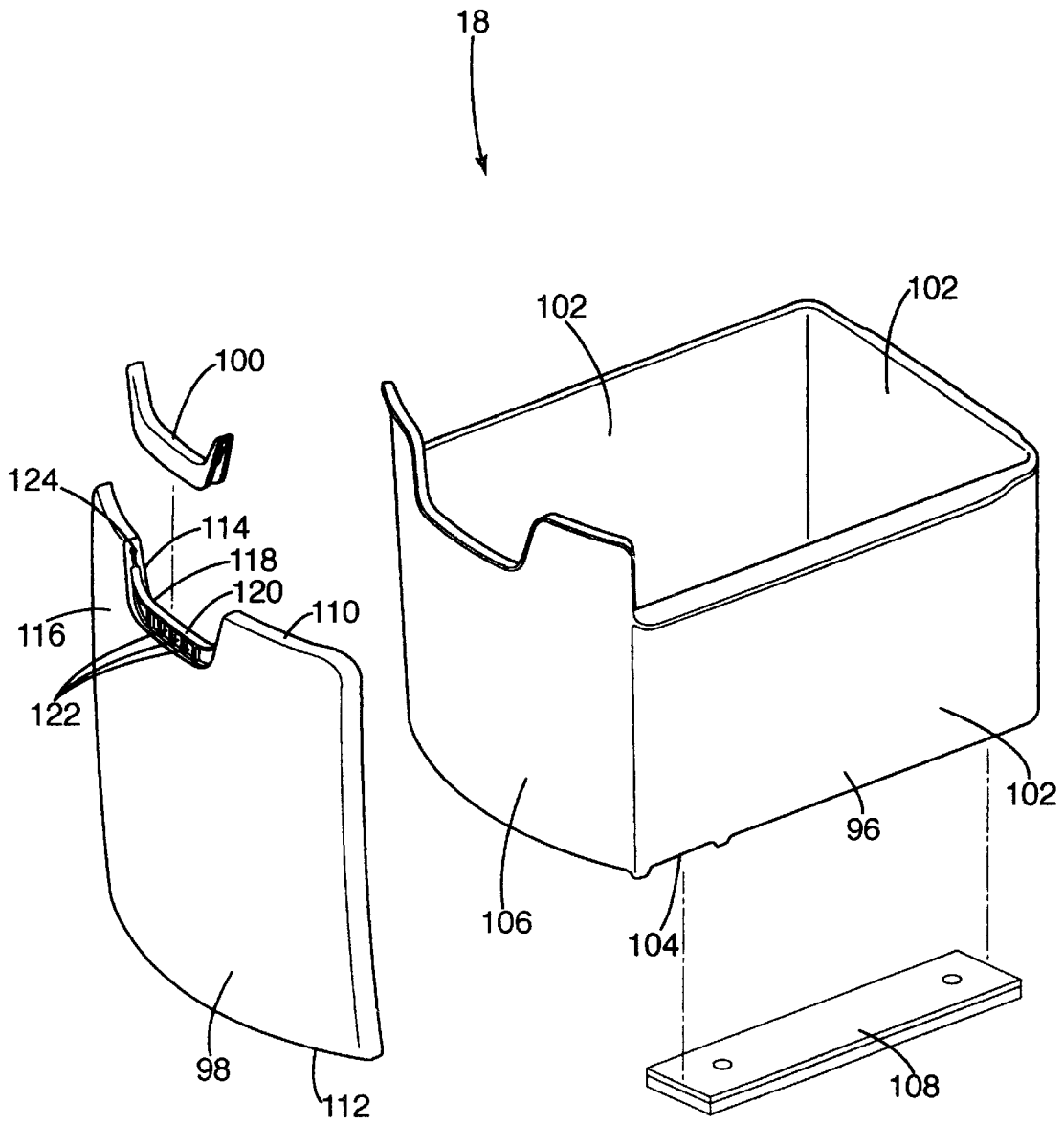
FIG. 11 is an exploded view of a drawer of the drawer pedestal.

The pedestal 10 further includes support 16, as shown in FIGS. 2 and 8–10. FIGS. 8 and 9 show a cross-section of the pedestal 10 at the point of connection between the substructure 12 and the shell 14 including the support 16. FIG. 10 shows a cross-section of the support 16 itself. The support 16 includes a left support panel 90, a right support panel 92, and a top support panel 94, also referred to as a supporting panel. The support 16 defines guide tab openings 95 to receive guide tabs 24 when the support 16 is positioned over the compartment 40. The support 16 may be constructed from any material with sufficient strength to support objects placed on the top shell wall 66 of the pedestal 10, for example, plastic, rubber and polystyrene foam. In a preferred embodiment the support 16 is constructed from expanded polystyrene foam.

The left support panel 90, right support panel 92 and top support panel 94 cooperate to form a seat of a cross-section that fits over a portion of the compartment 40 so that each of the left support panel 90, right support panel 92 and top support panel 94 contacts a portion, preferably substantially all, of the compartment wall 42. Additionally, the top support panel 94 contacts a portion, preferably substantially all, of the shell internal surface 79 of the top shell wall 66 of the shell 14 when the pedestal 10 is assembled. The support 16 functions to transfer loads from the top shell wall 66 to the compartment 40 and further to the substructure 12 and other walls of the shell 14. The support 16 preferably is frictionally fit between the compartment 40 and the shell 14, but may be secured with conventional adhesives. Optionally, the support 16 may be secured to the shell 14, substructure 12, or any other component of the drawer pedestal 10 with an adhesive or other fastener to prevent movement of the support 16 relative to the pedestal 10 and increase rigidity of the pedestal 10.

D. Drawer and Handle

Referring to FIGS. 11–16, an optional drawer 18 is interfit within the assembled pedestal 10. The drawer 18 includes a drawer box 96, front drawer panel 98 and handle 100. The drawer box 96 is generally rectangular and includes drawer side walls 102, a drawer bottom wall 104 and a drawer front wall 106. A drawer slide 108 is mounted on the drawer bottom wall 104 and slidably fits within the guide groove 138 of the base panel 30 to allow the drawer 18 to be extended and retracted in relation to the pedestal 10. As will be appreciated, other structures to facilitate movement of the drawer 18 relative to pedestal 10 may be used as desired.

The front drawer panel 98 includes a top panel end 110 and a bottom panel end 112, and an internal panel side 114 and an external panel side 116. The internal panel side 114 of the front drawer panel 98 is attached to the drawer front wall 106 of the drawer box 96. The front drawer panel 98 may be attached to the drawer box 96 by any conventional means. The front drawer panel 98 defines a U-shaped recess 118 along the top panel end 110. A rib 120 protrudes from the recess 118. The rib 120 includes a number of pockets 122, which add strength to the rib 120. Pockets 122 are located on both the internal panel side 114 and the external panel side 116. Any number of pockets may be used as desired.

Figure 15:
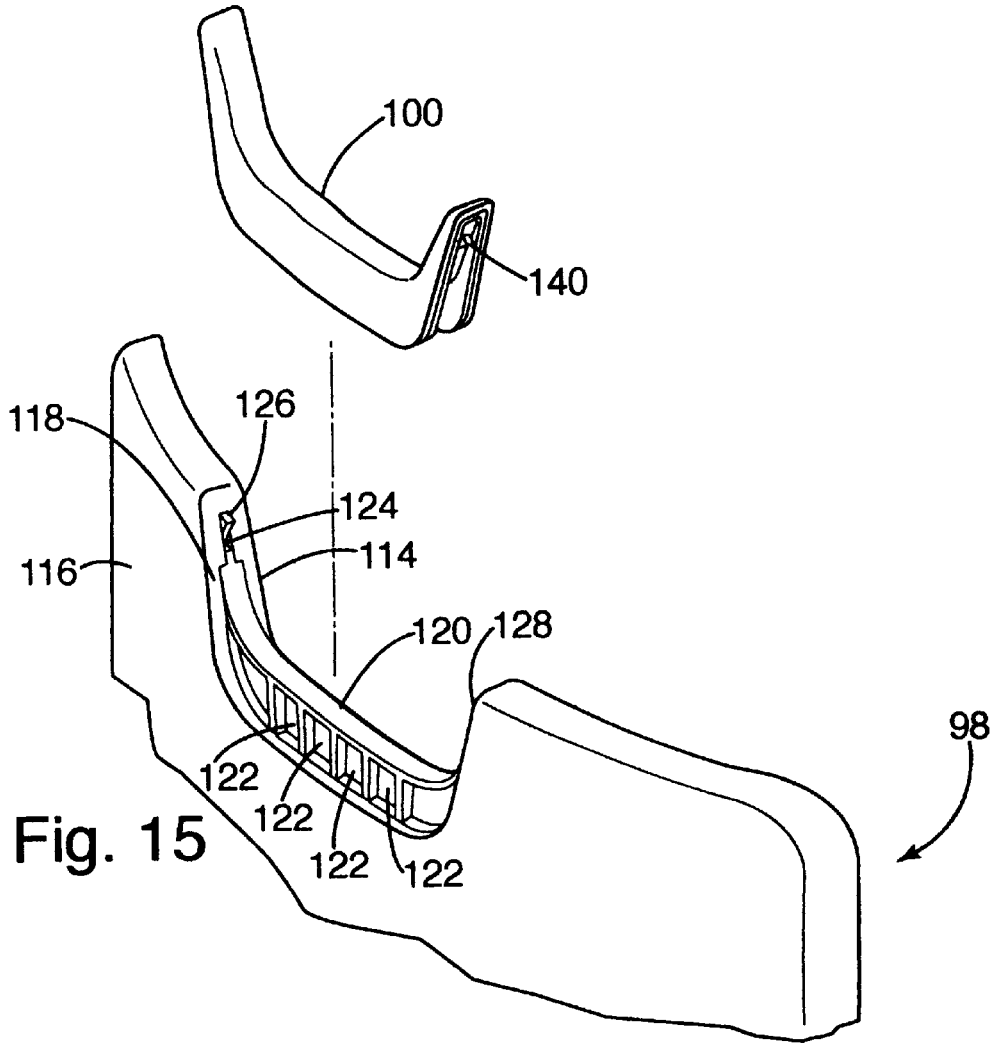
FIG. 15 is an exploded view of the handle and the drawer.
Figure 16:
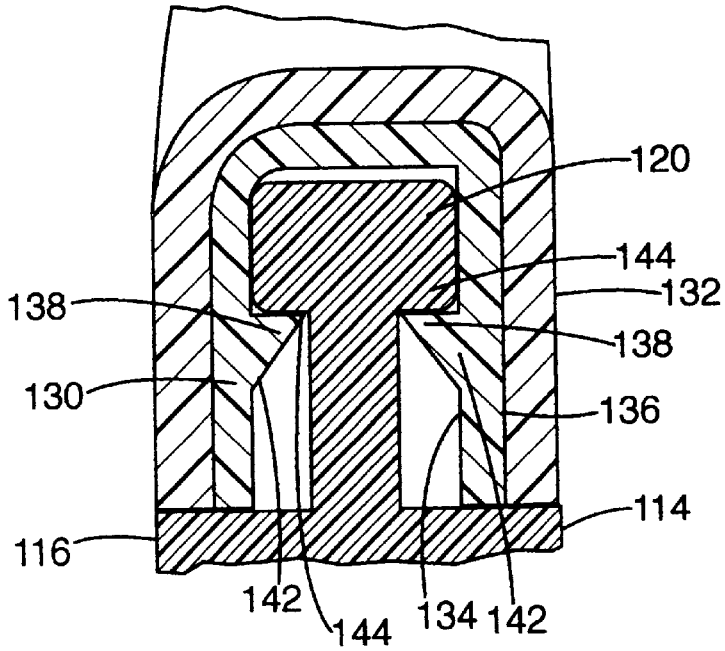
FIG. 16 is a cross-sectional view of the handle secured to the drawer.

With further reference to FIG. 15, the front drawer panel 98 includes snaps 124 on the left recess side 126 and right recess side 128 of the recess 118. Any number of snaps 124 may be used, but in a preferred embodiment there is one snap 124 on each of the left recess side 126 and right recess side 128 of the recess 118. The snaps 124 are located in the top half of each of the left recess side 126 and right recess side 128 of the recess 118.

Figure 12:
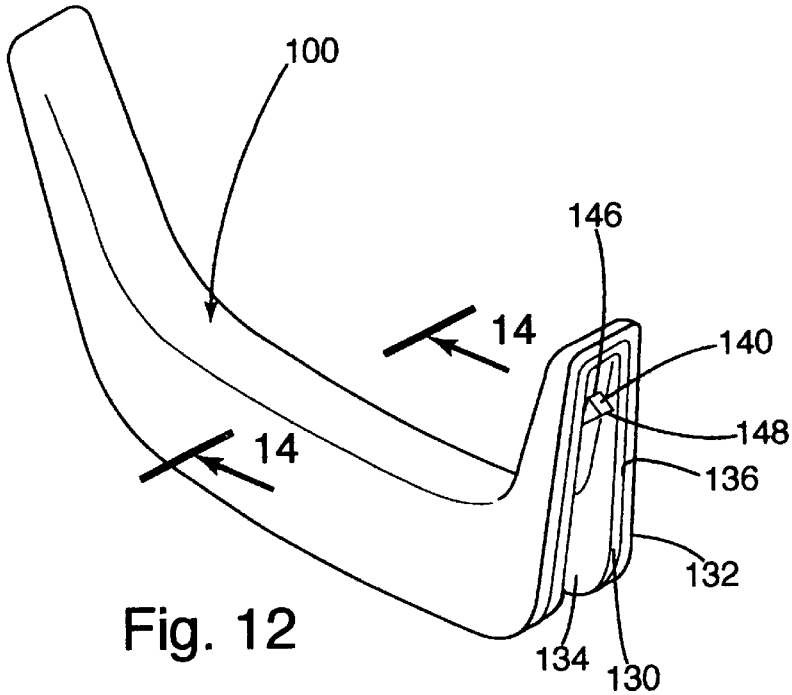
FIG. 12 is a perspective view of a handle of the drawer pedestal.
Figure 13:
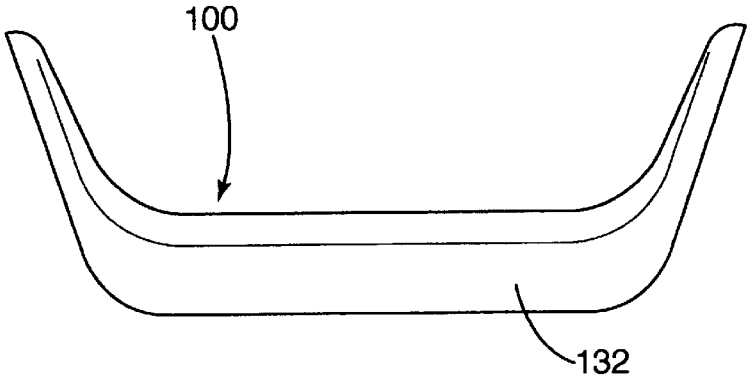
FIG. 13 is a front elevational view of the handle.
Figure 14:
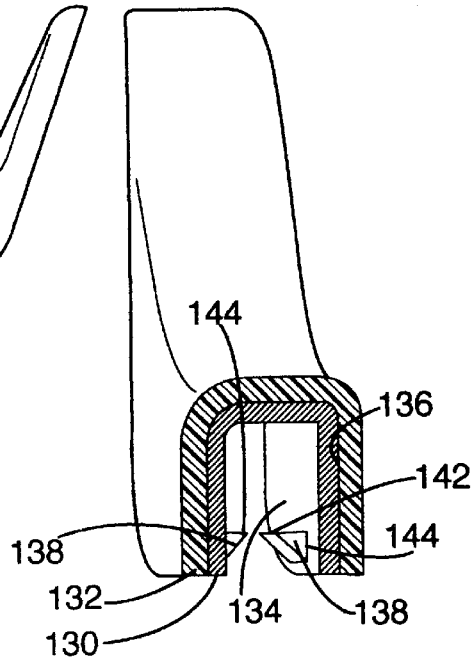
FIG. 14 is a cross-sectional view of the handle taken along line 14—14.

With reference to FIGS. 12–14, the handle 100 includes a substrate 130 and a molding 132. Preferably, the substrate 130 is made from any material with sufficient strength to be snapped onto the front drawer panel 98 and the substrate 130 is formed from a grippable plastic. The substrate 130 includes a substrate inner surface 134 and a substrate outer surface 136. The substrate 130 has generally a U-shaped cross-section to adequately interlock over the rib 120.

Additionally, the substrate 130 includes teeth 138 and catches 140. The base 142 of each tooth 138 is attached to the substrate inner surface 134 so that when the substrate 130 is placed over the rib 120, the tip 144 of each tooth 138 interlocks with a pocket 122. Preferably, the rib 120 includes at least as many pockets 122 as there are teeth 138 on the substrate 130.

Catches 140 are located on the substrate inner surface 134. Each catch includes a catch base 146 and a catch tip 148. The catch base 146 of each catch 140 is attached to the substrate inner surface 134 of the substrate 130 so that when the substrate 130 is placed over the rib 120, the catch tip 148 of each catch 140 interlocks with a snap 124 on the front drawer panel 98. The front drawer panel 98 includes at least as many snaps 124 as there are catches 140 on the substrate 130, and in a preferred embodiment the number of snaps 124 is equal to the number of catches 140.

The molding 132 is attached along substantially the entire substrate outer surface 136 of the substrate 130. The molding 132 may be made of any material capable of being attached to the substrate 130, but in a preferred embodiment the material is a textured plastic. The use of such material improves the feel and gripability of the handle 100. The molding 132 is preferably injection molded over the substrate outer surface 136 of the substrate 130.

II. Method of Assembly

To assemble a pedestal 10, the base panel 30 is secured to the shell 14. The support 16 is placed on top of the compartment 40. The substructure 12 is inserted into the outer shell 14. The guide tabs 24 align the locking tabs 22 with slots 20 so that the two may be secured along the rim 86 and flanges 32 to interlock the substructure 12 and shell 14. Additionally, the compartment guide tabs 72 align the compartment 40 with the compartment opening 70. As the substructure 12 is inserted into the shell 14, the guide tabs 24 and compartment guide tabs 72 are guided into the openings 95 on the support 16. The alignment of the guide tabs 24 and compartment guide tabs 72 with the openings 95 further aides the aligning of the locking tabs 22 and slots 20. When the substructure 12 is fully inserted into the shell 14, the locking tabs 22 interlock with the slots 20. In this interlocked configuration, the support 16 is frictionally fit between the compartment structure 40 and the shell 14. Frictionally fit means that the support is held in place by way of frictional forces created between the support and at least one of the compartment structure (or other structure of the substructure) and the shell.

The handle 100 is assembled by forming a substrate 130 with teeth 138 and catches 140. The molding 132 is attached to the substrate 130. The drawer 18 is assembled by attaching the internal panel side 114 of the front drawer panel 98 to the front drawer wall 106 of the drawer box 96. The handle 100 is pushed onto rib 120 until the teeth 138 interlock with pockets 122 and the catches 140 interlock with snaps 124. With the pedestal 10 assembled, the drawer 18 is interfit through drawer aperture 47. Drawer slide 108 is slidably positioned in slide groove 138 of base panel 30.

The above description is that of preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said" is not to be construed as limiting the element to the singular.

The embodiments of the invention in which an exclusive property or privilege is claimed are defined as follows:

1. An article of furniture comprising:

a shell including a top panel;

a substructure cooperating with the shell to define a cavity and including an exterior front, said substructure further including a shelf enclosure projecting into the cavity and opening through the exterior front, said shelf enclosure including a shelf to support an object placed thereon and a top located above the shelf;

a support panel having upper and lower surfaces, the upper surface engaging the top panel and the lower surface engaging the top of the shelf enclosure, wherein the support panel transfers loads from the top panel to the substructure.

2. The article of furniture of claim 1 wherein the shelf enclosure includes first and second opposing side walls, and wherein the support includes first and second panels extending downwardly therefrom adjacent said side walls.

3. An article of furniture comprising:

a shell including a top panel;

a substructure cooperating with the shell to define a cavity and including a first structure projecting into the cavity;

a support including a supporting panel and at least one other panel, the support frictionally fit between the top panel and the first structure with the supporting panel adjacent the top panel and the other panel generally conforming to the first structure, wherein the support transfers loads from the top panel to the first structure;

wherein the first structure defines a compartment therein; and wherein the shell defines an opening and at least a portion of the first structure rests within the opening to transfer loads from the first structure to the shell.

4. The article of furniture of claim 3 wherein the shell includes compartment guide tabs.

5. The article of furniture of claim 4 wherein the support includes compartment guide tab openings in which the compartment guide tabs are received.

6. An article of furniture comprising:

a shell including a top panel;

a substructure cooperating with the shell to define a cavity and including a first structure projecting into the cavity;

a support including a supporting panel and at least one other panel, the support frictionally fit between the top panel and the first structure with the supporting panel adjacent the top panel and the other panel generally conforming to the first structure, wherein the support transfers loads from the top panel to the first structure;

wherein the first structure defines a compartment therein; and wherein at least one of the shell and substructure includes alignment tabs that align the shell and substructure with one another.

7. The article of furniture of claim 6 wherein the support includes alignment tab openings in which the alignment tabs are received.

8. A drawer pedestal including an exterior comprising:

a shell including a work surface panel;

a substructure secured to the shell, said shell and said substructure cooperating to define a cavity, said substructure including a shelf that supports an object placed thereon and an exterior panel that forms at least a portion of the exterior of the drawer pedestal, said shelf projecting into said cavity and opening through said exterior panel; and a support including a supporting panel and first and second side panels secured to said supporting panel, said support positioned adjacent said work surface panel and adapted to transfer loads from said work surface panel to at least one of another portion of said shell and said substructure.

9. The drawer pedestal of claim 8 wherein said support is frictionally fit between said shell and said substructure.

10. The drawer pedestal of claim 9, wherein said support includes a plurality of openings.

11. The drawer pedestal of claim 8 wherein said substructure includes opposing upstanding side walls joined with the shelf to form a compartment.

12. The drawer pedestal of claim 8 wherein the shelf includes a top and wherein the support is fit between the work surface panel and the top.

13. The drawer pedestal of claim 12 wherein the shelf includes upstanding side walls that cooperate with the top to define a compartment.

14. The drawer pedestal of claim 13 wherein said exterior panel forms a front of the drawer pedestal.

15. A drawer pedestal comprising:

a shell including a work surface panel;

a substructure secured to the shell;

a support including a supporting panel and first and second side panels secured to said supporting panel, said support positioned adjacent said work surface panel and adapted to transfer loads from said work surface panel to at least one of said shell and said substructure; and wherein said substructure has a plurality of locking tabs and said shell has a number of slots adapted to receive said plurality of locking tabs.

16. A structural support member comprising:

a supporting panel that interfits against a load panel that forms a loading surface of an article;

a first side panel extending from and secured to said supporting panel;

a second side panel extending from and secured to said supporting panel wherein said supporting panel, said first panel and said second panel cooperate to define a seat located opposite the load panel, said seat cooperating with a component of the article and transferring loads from the load panel to the component; and wherein at least one of the supporting panel and first and second side panels define a plurality of guide tab openings adapted to receive guide tabs of the article.

17. The structural support member of claim 16 wherein the seat is substantially U-shaped.

* * * * *